United States Patent [19]

Sacca et al.

[11] Patent Number: 4,549,605

[45] Date of Patent: Oct. 29, 1985

[54] SINGLE INLET/OUTLET-TANK U-SHAPED TUBE HEAT EXCHANGER

[75] Inventors: Demetrio B. Sacca, Lockport; Donald E. Hoffman, West Seneca, both of N.Y.

[73] Assignee: General Motors Corporation, Detroit, Mich.

[21] Appl. No.: 642,099

[22] Filed: Aug. 20, 1984

[51] Int. Cl.[4] ..... F28F 9/26

[52] U.S. Cl. ..... 165/150; 165/151; 165/176

[58] Field of Search ..... 165/150, 151, 176

[56] References Cited

U.S. PATENT DOCUMENTS

| | | | |
|---|---|---|---|
| 1,856,963 | 5/1932 | Martin | 165/176 |
| 2,437,452 | 3/1948 | Baird | 165/151 |
| 2,733,899 | 2/1956 | Lehman | 165/176 |
| 3,080,916 | 3/1963 | Collins | 165/150 |
| 4,172,496 | 10/1979 | Melnyk | 165/150 |
| 4,483,392 | 11/1984 | Korsmo et al. | 165/151 |

FOREIGN PATENT DOCUMENTS

| | | | |
|---|---|---|---|
| 2039841 | 2/1972 | Fed. Rep. of Germany | 165/150 |
| 565014 | 1/1924 | France | 165/150 |

*Primary Examiner*—William R. Cline

*Assistant Examiner*—John J. McGlew, Jr.

*Attorney, Agent, or Firm*—R. L. Phillips

[57] ABSTRACT

A single inlet/outlet-tank U-shaped tube heat exchanger is disclosed comprising a tank having a header plate and a plurality of U-shaped tubes whose legs extend through and terminate with an open end at one side of the header plate. A first group of the tubes is arranged so that the two open ends of each of these tubes are located in one and the other of two outboard rows extending longitudinally of the header plate. A second group of the tubes with a smaller radius return bend is arranged in staggered pairs intermediate those in the first group and with their return bends parallel to each other and angled to those in the first group so that one open leg end of each of the tubes in the second group is located in one and the other of the outboard rows and the remaining open leg end of each of these tubes is located in a third and inboard row extending between the two outboard rows. A partition in the tank cooperates with the header plate to define an inlet chamber and an outlet chamber in the tank open respectively to the open tube ends in one and the other of the two outboard rows and also to alternate ones of the open tube ends in the inboard row whereby each of the tubes is connected to effect two-pass flow between said chambers.

2 Claims, 3 Drawing Figures

SINGLE INLET/OUTLET-TANK U-SHAPED TUBE HEAT EXCHANGER

TECHNICAL FIELD

This invention relates to single inlet/outlet-tank U-shaped tube heat exchangers and more particularly to those employing two rows of U-shaped tubes wherein each tube provides two-pass flow between the inlet and outlet.

BACKGROUND OF THE INVENTION

In heat exchangers of the above type, it is common practice where there are height and/or width limitations to increase the heat transfer capacity of a single tube row arrangement by simply adding an additional row of tubes. But this normally adds substantially to the core depth even where the tubes are arranged to overlap since each tube has two legs whose open ends are typically arranged in separate rows to make connection at a header plate with the inlet and outlet chambers in the tank for the two-pass flow by each tube. Moreover, the tank including the header plate must then also be increased in size depthwise to accommodate the additional row of tubes. This can present a substantial limitation particularly where the existing packaging space requirements do not permit the resulting increses in size.

For example, in the use of such a heat exchanger as a heater core in the passenger heating system of an automotive vehicle, the typical heater core with one row of U-shaped tubes may be found to lack sufficient heat capacity in a more demanding application so that an additional row is required. But with two rows of U-shaped tubes, there are normally four rows of tube legs that must be accommodated across the thickness or depth of the core and make connection at the header plate with the inlet and outlet chambers in the tank. However, the resulting increase in core depth, even where the tubes are arranged to overlap sideways, may not be possible within the confined space of the existing heater case thereby also reguiring accommodating alterations in the latter, provided such is possible within its space restraints in the vehicle. Moreover, where the heat exchanger is of the tube and fin type, this requires an accompanying increase in the depth of the fins as well as the tank and header plate.

SUMMARY OF THE INVENTION

The present invention allows the addition of a second group of U-shaped tubes in a manner such that all the tube legs can be arranged in just three rows so as not to require any increase in core depth but still each provide two-pass flow between the inlet and outlet of the tank. This is accomlished by arranging a first group of U-shaped tubes in conventional manner with their return bends parallel to the air flow and their two open leg ends located in one and the other of two longitudinally extending outboard rows at the header plate. A second group of tubes necessary to give the required additional heat transfer capacity is then provided but with a smaller radius bend. This permits their return bends to be arranged in staggered pairs parallel to each other and intermediate and angled transversely to those in the first group with one open leg end of each of the tubes in the second group located in one and the other of the two outboard rows and the remaining open leg end of each of these tubes located in a longitudinally extending inboard row at the header plate intermediate the two outboard rows, i.e., in an otherwise unused space in the core between the legs of the tubes in a single row arrangement. The single inlet/outlet-tank is then provided with a corrugated partition that coopertes with the header plate to divide the interior of the tank into an inlet chamber and an outlet chamber which are open respectively to the open leg ends in one and the other of the two outboard rows and are also open to alternate ones of the open leg ends of the tubes in the inboard row. And thus the open tube leg ends in all three rows are open to the respective inlet chamber and outlet chamber so as to effect two-pass flow by each of the U-shaped tubes between the chambers. The resulting three-row deep U-shaped tube arrangement thus does not require any more core depth than that of a single row of U-shaped tubes thereby minimizing the depth of the core in gaining the additional heating capacity.

These and other objects, advantages and features of the present invention will become more apparent from the following description and drawings in which:

Figure 1:
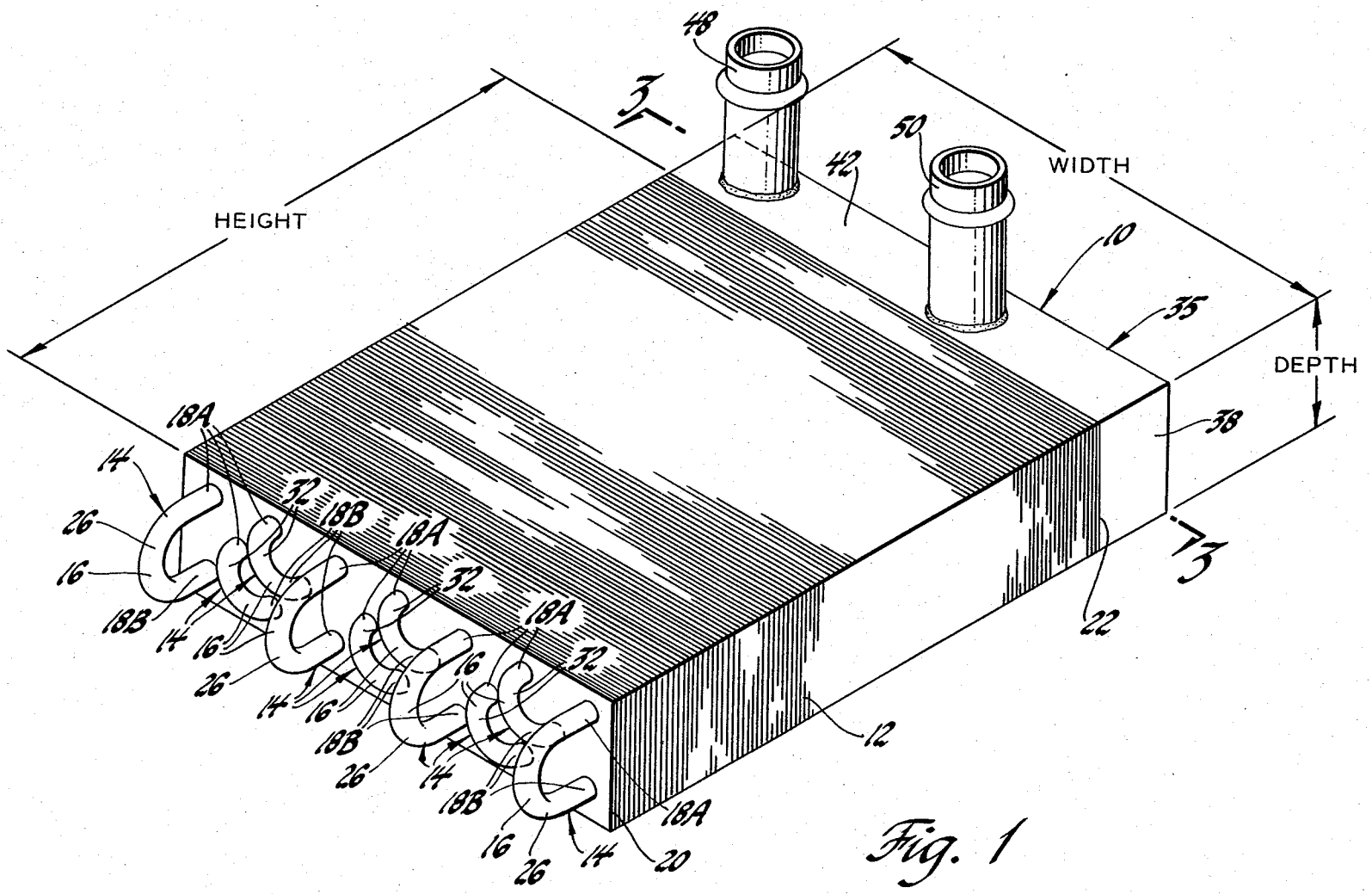
FIG. 1 is an isometric view of a heat exchanger having the preferred embodiment of the tube arrangement and inlet/outlet-tank constructed according to the present invention.

Referring to the drawings, the heat exchanger shown is made of aluminum and adapted for use as a heater core in the passenger heating system of an automotive vehicle. The heat exchanger is of the tube and fin type and basically comprises an inlet/outlet-tank 10, a plurality of fins 12 and a plurality of U-shaped tubes 14 also called hairpins. The tubes 14 each have a return bend 16 and a pair of parallel legs 18A, 18B with the latter extending from their return bend through an end plate 20, the fins 12 and thence through a header plate 22 which forms the bottom of the tank 10. Each tube leg 18A, 18B is sealingly secured to the header plate and terminates with an open end 24A, 24B respectively at one side of the header plate so as to be open to the interior of the tank (see FIGS. 2 and 3).

Figure 2:
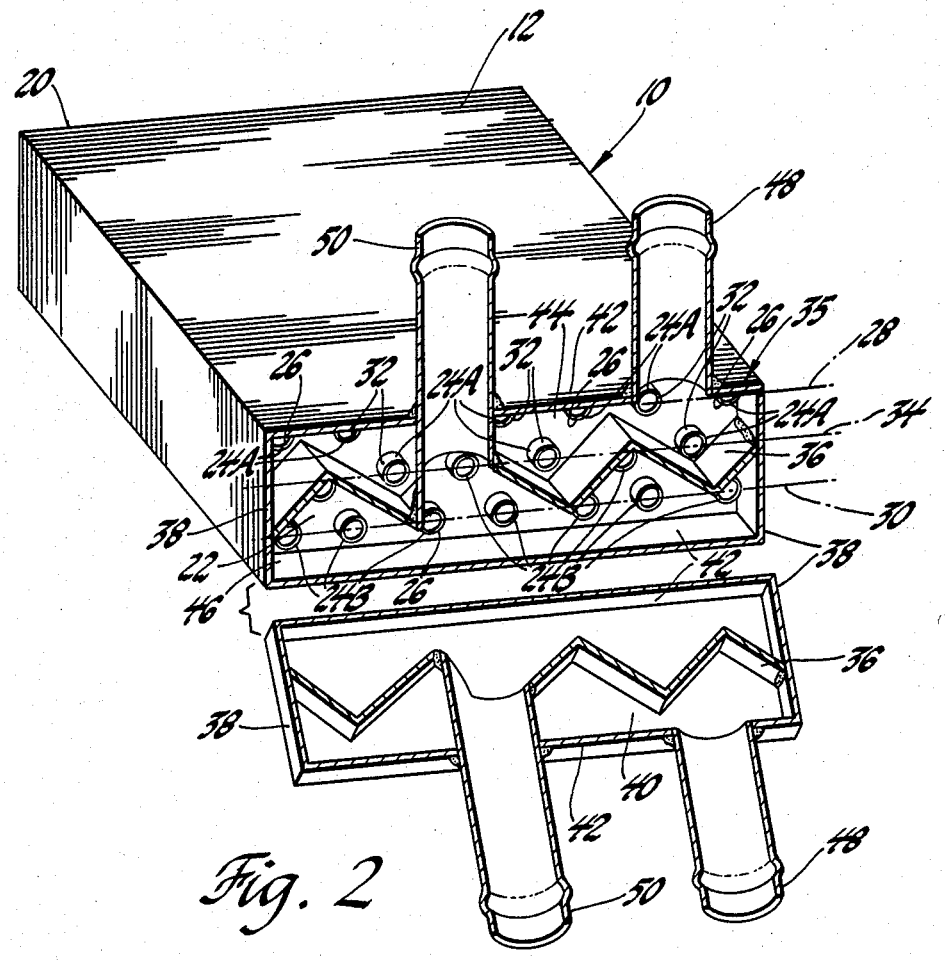
FIG. 2 is another isometric view of the heat exchanger in FIG. 1 with the inlet/outlet-tank broken and tilted away to expose the interior.
Figure 3:
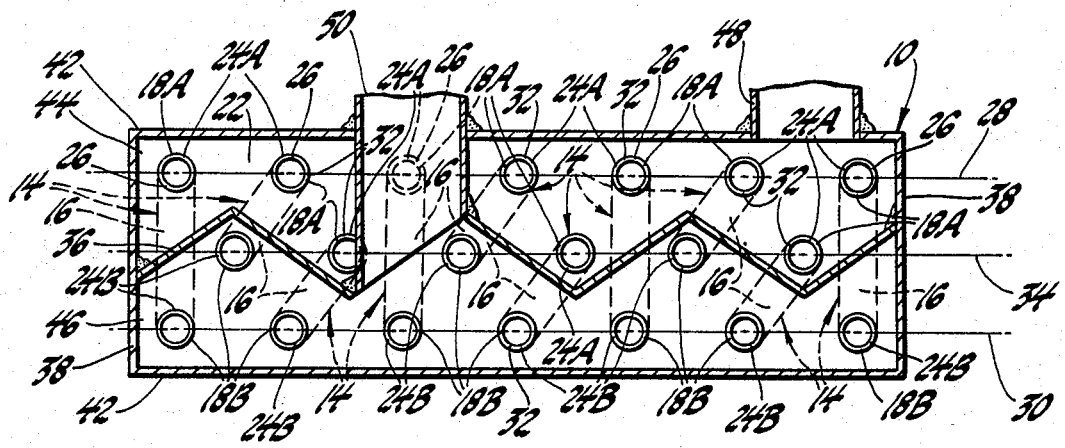
FIG. 3 is an enlarged sectional view taken along the line 3—3 in FIG. 1.

The tubes in the group identified as 26 and numbering four (4) have their return bends 16 arranged parallel to each other at right angles to the core width and parallel to the air flow and are equally spaced across the latter so as to have their open ends 24A and 24B located in two parallel outboard rows 28 and 30 extending longitudinally and adjacent the edge of the header plate 22 as best seen in FIGS. 2 and 3. On the other hand, the remaining tubes identified as group 32 and numbering six (6) have a smaller radius bend and are arranged in pairs with their bends parallel to each other and intermediate of and angled transversely to those in group 26. The tubes in group 32 are also staggered so that the one open leg end 24A and 24B of each of the tubes in this group is located in the respective outboard rows 28 and 30 and the remaining open leg end 24A and 24B of each of these tubes is located in a third and inboard row 34 extending along the length of the header plate 22 intermediate and parallel to the two outboard rows 28 and 30.

The inlet/outlet-tank 10 is formed by the header plate 32 and a five-sided rectangular shaped box 35 which is adapted to be sealingly fixed along the perimeter of the open side thereof to a corresponding edge of the header plate to thereby completely enclose the side of the header plate having the open tube ends 24A, 24B. In addition, there is provided a corrugated partition 36 which is sealingly secured along its perimeter to the interior of the tank at the two ends 38 and the top 40 of the box 35 and the interior side of the header plate 22. The partition 36 extends the length of the tank (i.e., the width of the core) midway between the two sides 42 thereof and joins with the ends 38 so as to divide the interior of the tank into a pair of chambers 44 and 46 which are connected with the heating system by pipes 48 and 50. The pipe 48 extends through and is sealingly connected to one of the walls 42 so as to directly connect with the chamber 44 while the other pipe 50 extends through and is sealingly connected to the same tank wall and the partition 36 so as to connect with the other chamber 46, the latter pipe thus also extending through the chamber 44. Depending upon the installation of the heater core, the pipes 48 and 50 may be alternately used as either the inlet or outlet connection for delivering liquid to and from the heat exchanger core.

As shown in FIGS. 2 and 3, the corrugated partition 36 has a saw-tooth wave-shape with respect to the open tube or leg ends 24A and 24B of the tubes in group 32 that occupy the inboard row 34 so that it weaves or zig-zags between these open tube ends in a manner such that the tank chambers 44 and 46 are open respectively to the open leg ends 24A and 24B in the respective outboard rows 28 and 30 and are also open to alternate ones of the open leg ends in the inboard row 34 so that the open leg ends 24A and 24B in the latter row are also open to the respective chambers 44 and 46. As a result, the open leg ends 24A and 24B in all three rows are open to the respective chambers 44 and 46 and thus to the inlet and outlet connections with the heater core so that each tube thus provides two-pass flow between the inlet and outlet.

And thus though an additional group of U-shaped tubes has been added to what might be considered a conventional single row arrangement, the intermediate location of the additional but smaller return bend radius tubes results in just three rows of open tube ends which with the simple addition of the corrugated partition maintains two-pass flow with all the return bent tubes separately interconnecting the inlet and outlet chambers of the tank. This intermediate location of the tubes comprising group 32 is thus in what would normally be an unused space in the core and therefore does not require any increase in core depth or size of the tank including the header plate. And it will also be appreciated that the heat exchanger with or without fins is adaptive to other uses.

Furthermore, while the preferred construction is shown with a certain number of tubes, it will be appreciated, of course, that more or less tubes may be employed after the above manner depending upon the heat capacity required for a particular application. Furthermore, the shape of the partition may obviously take other forms in providing the two-pass connections taught above.

The above described preferred embodiment is thus illustrative of the invention which may be modified within the scope of the appended claims.

The embodiments of the invention in which an exclusive property or privilege is claimed are defined as follows:

1. A heat exchanger comprising a tank having a header plate, a plurality of tubes each having two legs joined by a return bend, the legs of said tubes extending through and terminating with an open end at one side of said header plate, a first group of said tubes being arranged so as to each have their two open ends located in one and the other of two outboard rows extending longitudinally of said header plate, a second and remaining group of said tubes having a return bend radius smaller than that of said first group and resultantly closer together legs and being arranged in pairs with their return bends between those of the tubes in said first group so that one open end of each of the tubes in each said pair is located in one of said outboard rows and the other open end of each of the tubes in each said pair is located in a third and inboard row extending between said two outboard rows, and partition means in said tank for cooperating with said header plate to define an inlet chamber and an outlet chamber in said tank open respectively to the open tube ends in one and the other of said two outboard rows and also to alternate ones of the open tube ends in said inboard row whereby each said tube is connected to effect two-pass flow between said chambers.

2. A heat exchanger comprising a tank having a header plate, a plurality of tubes each having two legs joined by a return bend, the legs of said tubes extending through and terminating with an open end at one side of said header plate, a first group of said tubes being arranged so as to each have their two open ends located in one and the other of two outboard rows extending longitudinally of said header plate, second rows extending longitudinally of said header plate, a second and remaining group of said tubes having a return bend radius smaller than that of said first group and resultantly closer together legs and being arranged in pairs with their return bends between those of the tubes in said first group, the return bends of the tubes in said second group parallel to each other but angled to those in said first group so that one open end of one of the tubes in each said pair is located in one of said one outboard rows and one open end of the other of the tubes in each said pair is located in the other of said outboard rows and the other open end of each of the tubes in each said pair is located in a third and inboard row extending between said two outboard rows, and partition means in said tank for cooperating with said header plate to define an inlet chamber and an outlet chamber in said tank open respectively to the open tube ends in one and the other of said two outboard rows and also to alternate ones of the open tube ends in said inboard row whereby each said tube is connected to effect two-pass flow between said chambers.

* * * * *

UNITED STATES PATENT AND TRADEMARK OFFICE

CERTIFICATE OF CORRECTION

PATENT NO. : 4,549,605

DATED : October 29, 1985

INVENTOR(S) : Demetrio B. Sacca & Donald E. Hoffman

It is certified that error appears in the above-identified patent and that said Letters Patent is hereby corrected as shown below:

Column 1, line 27, "increses" should read -- increases --.

Column 1, line 41, "reguiring" should read -- requiring --.

Column 2, line 4, "coopertes" should read -- cooperates --.

Column 4, lines 41-42, claim 2, after "plate," delete "second rows extending longitudinally of said header plate,".

Signed and Sealed this

*Twenty-eighth* Day of *January 1986*

[SEAL]

*Attest:*

DONALD J. QUIGG

*Attesting Officer*

*Commissioner of Patents and Trademarks*